US008704720B2

(12) United States Patent
Kish et al.

(10) Patent No.: US 8,704,720 B2
(45) Date of Patent: Apr. 22, 2014

(54) COVERAGE ANTENNA APPARATUS WITH SELECTABLE HORIZONTAL AND VERTICAL POLARIZATION ELEMENTS

(75) Inventors: William Kish, Saratoga, CA (US); Victor Shtrom, Sunnyvale, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 0 days.

(21) Appl. No.: 13/280,278

(22) Filed: Oct. 24, 2011

(65) Prior Publication Data

US 2012/0098730 A1 Apr. 26, 2012

Related U.S. Application Data

(63) Continuation of application No. 12/082,090, filed on Apr. 7, 2008, now Pat. No. 8,068,068, which is a continuation of application No. 11/413,461, filed on Apr. 28, 2006, now Pat. No. 7,358,912.

(60) Provisional application No. 60/694,101, filed on Jun. 24, 2005.

(51) Int. Cl.
*H01Q 13/10* (2006.01)

(52) U.S. Cl.
USPC ..... 343/770; 343/767

(58) Field of Classification Search
USPC ..... 343/770, 771, 725, 727, 893, 767, 833, 343/834
See application file for complete search history.

(56) References Cited

U.S. PATENT DOCUMENTS

| | | | | |
|---|---|---|---|---|
| 725,605 A | | 4/1903 | Tesla | |
| 1,869,659 A | | 8/1932 | Broertjes | |
| 2,292,387 A | | 8/1942 | Markey et al. | |
| 3,488,445 A | | 1/1970 | Chang | |
| 3,568,105 A | | 3/1971 | Felsenheld | |
| 3,721,990 A | | 3/1973 | Gibson et al. | |
| 3,887,925 A | | 6/1975 | Ranghelli | |
| 3,967,067 A | | 6/1976 | Potter | |
| 3,969,730 A | * | 7/1976 | Fuchser | 343/770 |
| 3,982,214 A | | 9/1976 | Burns | |
| 3,991,273 A | | 11/1976 | Mathes | |
| 4,001,734 A | | 1/1977 | Burns | |
| 4,027,307 A | | 5/1977 | Litchford | |

(Continued)

FOREIGN PATENT DOCUMENTS

| | | |
|---|---|---|
| AU | 2003/227399 | 10/2003 |
| CA | 02494982 | 10/2003 |

(Continued)

OTHER PUBLICATIONS

*Ruckus Wireless, Inc.* vs. *Netgear, Inc*; Defendant Netgear, Inc. Invalidity Contentions.

(Continued)

*Primary Examiner* — Hoang V Nguyen

(74) *Attorney, Agent, or Firm* — Lewis Roca Rothgerber LLP

(57) ABSTRACT

An antenna apparatus comprises selectable antenna elements including a plurality of dipoles and/or a plurality of slot antennas ("slot"). Each dipole and/or each slot provides gain with respect to isotropic. The dipoles may generate vertically polarized radiation and the slots may generate horizontally polarized radiation. Each antenna element may have one or more loading structures configured to decrease the footprint (i.e., the physical dimension) of the antenna element and minimize the size of the antenna apparatus.

7 Claims, 7 Drawing Sheets

(56) References Cited

U.S. PATENT DOCUMENTS 4,176,356 A 11/1979 Foster et al.
4,193,077 A 3/1980 Greenberg et al.
4,203,118 A 5/1980 Alford
4,253,193 A 2/1981 Kennard
4,305,052 A 12/1981 Baril et al.
4,513,412 A 4/1985 Cox
4,554,554 A 11/1985 Olesen et al.
4,733,203 A 3/1988 Ayasli
4,764,773 A 8/1988 Larsen et al.
4,800,393 A 1/1989 Edward et al.
4,814,777 A 3/1989 Monser
4,821,040 A 4/1989 Johnson et al.
5,063,574 A 11/1991 Moose
5,097,484 A 3/1992 Akaiwa
5,173,711 A 12/1992 Takeuchi et al.
5,203,010 A 4/1993 Felix
5,208,564 A 5/1993 Burns et al.
5,220,340 A 6/1993 Shafai
5,241,693 A 8/1993 Kim
5,282,222 A 1/1994 Fattouche et al.
5,291,289 A 3/1994 Hulyalkar et al.
5,311,550 A 5/1994 Fouche et al.
5,373,548 A 12/1994 McCarthy
5,434,575 A 7/1995 Jelinek
5,453,752 A 9/1995 Wang et al.
5,479,176 A 12/1995 Zavrel
5,507,035 A 4/1996 Bantz
5,532,708 A 7/1996 Krenz et al.
5,559,800 A 9/1996 Mousseau et al.
5,726,666 A 3/1998 Hoover et al.
5,754,145 A 5/1998 Evans
5,767,755 A 6/1998 Kim et al.
5,767,807 A 6/1998 Prtichett
5,767,809 A 6/1998 Chuang et al.
5,786,793 A 7/1998 Maeda et al.
5,802,312 A 9/1998 Lazaridis et al.
5,828,346 A 10/1998 Park
5,936,595 A 8/1999 Wang
5,964,830 A 10/1999 Durrett
5,990,838 A 11/1999 Burns et al.
6,005,525 A 12/1999 Kivela
6,011,450 A 1/2000 Miya
6,031,503 A 2/2000 Preiss, II et al.
6,034,638 A 3/2000 Thiel et al.
6,046,703 A 4/2000 Wang
6,052,093 A 4/2000 Yao et al.
6,091,364 A 7/2000 Murakami et al.
6,094,177 A 7/2000 Yamamoto
6,097,347 A * 8/2000 Duan et al. ..... 343/802
6,104,356 A 8/2000 Hikuma et al.
6,169,523 B1 1/2001 Ploussios
6,249,216 B1 6/2001 Flick
6,266,528 B1 7/2001 Farzaneh
6,281,762 B1 8/2001 Nakao
6,288,682 B1 9/2001 Thiel et al.
6,292,153 B1 9/2001 Aiello et al.
6,307,524 B1 10/2001 Britain
6,317,599 B1 11/2001 Rappaport et al.
6,323,810 B1 11/2001 Poilasne et al.
6,326,922 B1 12/2001 Hegendoerfer
6,326,924 B1 12/2001 Muramoto et al.
6,337,628 B2 1/2002 Campana, Jr.
6,337,668 B1 1/2002 Ito et al.
6,339,404 B1 1/2002 Johnson
6,345,043 B1 2/2002 Hsu
6,356,242 B1 3/2002 Ploussios
6,356,243 B1 3/2002 Schneider et al.
6,356,905 B1 3/2002 Gershman et al.
6,366,254 B1 4/2002 Sievenpiper
6,377,227 B1 4/2002 Zhu et al.
6,392,610 B1 5/2002 Braun et al.
6,400,329 B1 6/2002 Barnes
6,404,386 B1 6/2002 Proctor, Jr. et al.
6,407,719 B1 6/2002 Ohira et al.
RE37,802 E 7/2002 Fattouche et al.
6,414,647 B1 7/2002 Lee
6,424,311 B1 7/2002 Tsai et al.
6,442,507 B1 8/2002 Skidmore et al.
6,445,688 B1 9/2002 Garces et al.
6,456,242 B1 * 9/2002 Crawford ..... 343/700 MS
6,476,773 B2 11/2002 Palmer
6,492,957 B2 12/2002 Carillo et al.
6,493,679 B1 12/2002 Rappaport et al.
6,496,083 B1 12/2002 Kushitani et al.
6,498,589 B1 12/2002 Horii
6,499,006 B1 12/2002 Rappaport et al.
6,507,321 B2 1/2003 Oberschmidt et al.
6,521,422 B1 2/2003 Hsu
6,531,985 B1 3/2003 Jones et al.
6,545,643 B1 4/2003 Sward
6,583,765 B1 * 6/2003 Schamberger et al. ..... 343/770
6,586,786 B2 7/2003 Kitazawa et al.
6,593,891 B2 7/2003 Zhang
6,606,059 B1 8/2003 Barabash
6,611,230 B2 8/2003 Phelan
6,621,029 B2 9/2003 Galmiche
6,625,454 B1 9/2003 Rappaport et al.
6,633,206 B1 10/2003 Kato
6,642,889 B1 11/2003 McGrath
6,642,890 B1 11/2003 Chen
6,674,459 B2 1/2004 Ben-Shachar et al.
6,700,546 B2 3/2004 Benhammou et al.
6,701,522 B1 3/2004 Rubin et al.
6,724,346 B2 4/2004 Le Bolzer
6,725,281 B1 4/2004 Zintel et al.
6,741,219 B2 5/2004 Shor
6,747,605 B2 6/2004 Lebaric
6,753,814 B2 6/2004 Killen et al.
6,757,267 B1 6/2004 Evans
6,762,723 B2 7/2004 Nallo et al.
6,774,852 B2 8/2004 Chiang et al.
6,774,864 B2 8/2004 Evans
6,779,004 B1 8/2004 Zintel et al.
6,819,287 B2 11/2004 Sullivan et al.
6,839,038 B2 1/2005 Weinstein
6,859,176 B2 2/2005 Choi
6,859,182 B2 2/2005 Horii
6,864,852 B2 3/2005 Chiang et al.
6,876,280 B2 4/2005 Nakano
6,876,836 B2 4/2005 Lin
6,879,293 B2 4/2005 Sato
6,888,504 B2 5/2005 Chiang et al.
6,888,893 B2 5/2005 Li et al.
6,892,230 B1 5/2005 Gu et al.
6,894,653 B2 5/2005 Chiang et al.
6,903,686 B2 6/2005 Vance et al.
6,906,678 B2 6/2005 Chen
6,910,068 B2 6/2005 Zintel et al.
6,914,581 B1 7/2005 Popek
6,924,768 B2 8/2005 Wu et al.
6,931,429 B2 8/2005 Gouge et al.
6,933,907 B2 8/2005 Shirosaka
6,941,143 B2 9/2005 Mathur
6,943,749 B2 9/2005 Paun
6,950,019 B2 9/2005 Bellone et al.
6,950,069 B2 9/2005 Gaucher et al.
6,961,028 B2 11/2005 Joy et al.
6,965,353 B2 11/2005 Shirosaka et al.
6,973,622 B1 12/2005 Rappaport et al.
6,975,834 B1 12/2005 Forster
6,980,782 B1 12/2005 Braun et al.
7,023,909 B1 * 4/2006 Adams et al. ..... 375/222
7,024,225 B2 4/2006 Ito
7,034,769 B2 4/2006 Surducan et al.
7,034,770 B2 4/2006 Yang et al.
7,043,277 B1 5/2006 Pfister
7,046,201 B2 5/2006 Okada
7,050,809 B2 5/2006 Lim
7,053,844 B2 5/2006 Gaucher et al.
7,064,717 B2 6/2006 Kaluzni
7,085,814 B1 8/2006 Gandhi et al.
7,088,299 B2 8/2006 Siegler et al.
7,088,306 B2 8/2006 Chiang et al.
7,089,307 B2 8/2006 Zintel et al.

(56) References Cited

U.S. PATENT DOCUMENTS 7,098,863 B2 8/2006 Bancroft
D530,325 S 10/2006 Kerila
7,120,405 B2 10/2006 Rofougaran
7,130,895 B2 10/2006 Zintel et al.
7,148,846 B2 12/2006 Qi et al.
7,162,273 B1 1/2007 Abramov et al.
7,164,380 B2 1/2007 Saito
7,171,475 B2 1/2007 Weisman et al.
7,193,562 B2 3/2007 Shtrom
7,206,610 B2 4/2007 Iacono et al.
7,215,296 B2 5/2007 Abramov et al.
7,277,063 B2 10/2007 Shirosaka et al.
7,292,198 B2 11/2007 Shtrom
7,292,870 B2 11/2007 Heredia et al.
7,295,825 B2 11/2007 Raddant
7,298,228 B2 11/2007 Sievenpiper
7,312,762 B2 12/2007 Puente Ballarda et al.
7,319,432 B2 1/2008 Andersson
7,333,460 B2 2/2008 Vaisanen et al.
7,358,912 B1 4/2008 Kish et al.
7,362,280 B2 4/2008 Shtrom
7,385,563 B2 6/2008 Bishop
7,498,999 B2 3/2009 Shtrom et al.
7,511,680 B2 3/2009 Shtrom et al.
7,522,569 B2 4/2009 Rada et al.
7,525,486 B2 4/2009 Shtrom
7,609,648 B2 10/2009 Hoffmann et al.
7,697,550 B2 4/2010 Rada
7,733,275 B2 6/2010 Hirota
7,782,895 B2 8/2010 Pasanen et al.
7,835,697 B2 11/2010 Wright
7,847,741 B2 12/2010 Hirota
7,864,119 B2 1/2011 Shtrom et al.
7,893,882 B2 2/2011 Shtrom
7,916,463 B2 3/2011 Aya et al.
8,068,068 B2 11/2011 Kish et al.
8,085,206 B2 12/2011 Shtrom
8,217,843 B2 7/2012 Shtrom
8,358,248 B2 1/2013 Shtrom
2001/0046848 A1 11/2001 Kenkel
2002/0031130 A1 3/2002 Tsuchiya et al.
2002/0036586 A1 3/2002 Gothard et al.
2002/0047800 A1 4/2002 Proctor, Jr. et al.
2002/0080767 A1 6/2002 Lee
2002/0084942 A1 7/2002 Tsai et al.
2002/0101377 A1 8/2002 Crawford
2002/0105471 A1 8/2002 Kojima et al.
2002/0112058 A1 8/2002 Weisman et al.
2002/0119757 A1 8/2002 Hamabe
2002/0158798 A1 10/2002 Chiang et al.
2002/0170064 A1 11/2002 Monroe et al.
2003/0026240 A1 2/2003 Eyuboglu et al.
2003/0030588 A1 2/2003 Kalis et al.
2003/0038698 A1 2/2003 Hirayama
2003/0063591 A1 4/2003 Leung et al.
2003/0122714 A1 7/2003 Wannagot et al.
2003/0169330 A1 9/2003 Ben-Shachar et al.
2003/0184490 A1 10/2003 Raiman et al.
2003/0189514 A1 10/2003 Miyano et al.
2003/0189521 A1 10/2003 Yamamoto et al.
2003/0189523 A1 10/2003 Ojantakanen et al.
2003/0210207 A1 11/2003 Suh et al.
2003/0214446 A1 11/2003 Shehab
2003/0227414 A1 12/2003 Saliga et al.
2004/0014432 A1 1/2004 Boyle
2004/0017310 A1 1/2004 Vargas-Hurlston et al.
2004/0017315 A1 1/2004 Fang et al.
2004/0017860 A1 1/2004 Liu
2004/0027291 A1 2/2004 Zhang et al.
2004/0027304 A1 2/2004 Chiang et al.
2004/0032378 A1 2/2004 Volman et al.
2004/0036651 A1 2/2004 Toda
2004/0036654 A1 2/2004 Hsieh
2004/0041732 A1 3/2004 Aikawa et al.
2004/0048593 A1 3/2004 Sano
2004/0058690 A1 3/2004 Ratzel et al.
2004/0061653 A1 4/2004 Webb et al.
2004/0070543 A1 4/2004 Masaki
2004/0075609 A1 4/2004 Li
2004/0080455 A1 4/2004 Lee
2004/0090371 A1 5/2004 Rossman
2004/0095278 A1 5/2004 Kanemoto et al.
2004/0114535 A1 6/2004 Hoffmann et al.
2004/0125777 A1 7/2004 Doyle et al.
2004/0145528 A1 7/2004 Mukai et al.
2004/0160376 A1 8/2004 Hornsby et al.
2004/0190477 A1 9/2004 Olson et al.
2004/0203347 A1 10/2004 Nguyen
2004/0207563 A1 10/2004 Yang
2004/0227669 A1 11/2004 Okado
2004/0260800 A1 12/2004 Gu et al.
2005/0022210 A1 1/2005 Zintel et al.
2005/0041739 A1 2/2005 Li et al.
2005/0042988 A1 2/2005 Hoek et al.
2005/0048934 A1 3/2005 Rawnick et al.
2005/0062649 A1 3/2005 Chiang et al.
2005/0074018 A1 4/2005 Zintel et al.
2005/0097503 A1 5/2005 Zintel et al.
2005/0122265 A1 6/2005 Gaucher et al.
2005/0128983 A1 6/2005 Kim et al.
2005/0128988 A1 6/2005 Simpson et al.
2005/0135480 A1 6/2005 Li et al.
2005/0138137 A1 6/2005 Encarnacion et al.
2005/0138193 A1 6/2005 Encarnacion et al.
2005/0146475 A1 7/2005 Bettner et al.
2005/0180381 A1 8/2005 Retzer et al.
2005/0188193 A1 8/2005 Kuehnel et al.
2005/0237258 A1 10/2005 Abramov et al.
2005/0240665 A1 10/2005 Gu et al.
2005/0267935 A1 12/2005 Gandhi et al.
2006/0031922 A1 2/2006 Sakai
2006/0038734 A1 2/2006 Shtrom et al.
2006/0050005 A1 3/2006 Shirosaka et al.
2006/0094371 A1 5/2006 Nguyen
2006/0098607 A1 5/2006 Zeng et al.
2006/0109191 A1 5/2006 Shtrom
2006/0123124 A1 6/2006 Weisman et al.
2006/0123125 A1 6/2006 Weisman et al.
2006/0123455 A1 6/2006 Pai et al.
2006/0168159 A1 7/2006 Weisman et al.
2006/0184660 A1 8/2006 Rao et al.
2006/0184661 A1 8/2006 Weisman et al.
2006/0184693 A1 8/2006 Rao et al.
2006/0224690 A1 10/2006 Falkenburg et al.
2006/0225107 A1 10/2006 Seetharaman et al.
2006/0227761 A1 10/2006 Scott, III et al.
2006/0239369 A1 10/2006 Lee
2006/0251256 A1 11/2006 Asokan et al.
2006/0262015 A1 11/2006 Thornell-Pers et al.
2006/0291434 A1 12/2006 Gu et al.
2007/0027622 A1 2/2007 Cleron et al.
2007/0037619 A1 2/2007 Matsunaga et al.
2007/0055752 A1 3/2007 Wiegand et al.
2007/0115180 A1 5/2007 Kish et al.
2007/0135167 A1 6/2007 Liu
2008/0060064 A1 3/2008 Wynn et al.
2008/0062058 A1 3/2008 Bishop
2008/0075280 A1 3/2008 Ye et al.
2008/0096492 A1 4/2008 Yoon
2008/0109657 A1 5/2008 Bajaj et al.
2008/0136715 A1 6/2008 Shtrom
2008/0212535 A1 9/2008 Karaoguz et al.
2008/0272977 A1 11/2008 Gaucher et al.
2009/0005005 A1 1/2009 Forstall et al.
2009/0103731 A1 4/2009 Sarikaya
2009/0187970 A1 7/2009 Mower et al.
2009/0219903 A1 9/2009 Alamouti et al.
2009/0295648 A1 12/2009 Dorsey et al.
2009/0315794 A1 12/2009 Alamouti et al.
2010/0053023 A1 3/2010 Shtrom
2011/0007705 A1 1/2011 Buddhikot et al.
2011/0047603 A1 2/2011 Gordon et al.
2011/0095960 A1 4/2011 Shtrom
2011/0126016 A1 5/2011 Sun

(56) References Cited

U.S. PATENT DOCUMENTS

| | | | |
|---|---|---|---|
| 2012/0030466 | A1 | 2/2012 | Yamaguchi |
| 2012/0054338 | A1 | 3/2012 | Ando |
| 2012/0089845 | A1 | 4/2012 | Raleigh |
| 2012/0134291 | A1 | 5/2012 | Raleigh |
| 2012/0257536 | A1 | 10/2012 | Kholaif et al. |
| 2012/0299772 | A1 | 11/2012 | Shtrom |
| 2013/0007853 | A1 | 1/2013 | Gupta et al. |
| 2013/0038496 | A1 | 2/2013 | Shtrom |
| 2013/0182693 | A1 | 7/2013 | Sperling et al. |
| 2013/0207865 | A1 | 8/2013 | Shtrom |
| 2013/0207866 | A1 | 8/2013 | Shtrom |
| 2013/0207877 | A1 | 8/2013 | Shtrom |
| 2013/0212656 | A1 | 8/2013 | Shtrom |
| 2013/0241789 | A1 | 9/2013 | Shtrom |
| 2013/0269008 | A1 | 10/2013 | Shtrom |

FOREIGN PATENT DOCUMENTS

| | | | |
|---|---|---|---|
| DE | 10 2006 02635 | | 12/2006 |
| EP | 352 787 | | 1/1990 |
| EP | 0 534 612 | | 3/1993 |
| EP | 0 756 381 | | 1/1997 |
| EP | 0 883 206 | | 12/1998 |
| EP | 1 152 542 | | 11/2001 |
| EP | 1 152 543 | | 11/2001 |
| EP | 1 376 920 | | 6/2002 |
| EP | 1 220 461 | | 7/2002 |
| EP | 1 315 311 | | 5/2003 |
| EP | 1 450 521 | | 8/2004 |
| EP | 1 608 108 | | 12/2005 |
| EP | 1 909 358 | | 4/2008 |
| EP | 1 287 588 | | 1/2009 |
| GB | 2 426 870 | | 6/2006 |
| GB | 2 423 191 | | 8/2006 |
| JP | 03038933 | | 2/1991 |
| JP | 2008/088633 | | 4/1996 |
| JP | 2001-057560 | | 2/2001 |
| JP | 2002-505835 | | 2/2002 |
| JP | 2005-354249 | | 12/2005 |
| JP | 2006/060408 | | 3/2006 |
| WO | WO 90/04893 | | 5/1990 |
| WO | WO 99/55012 | | 10/1999 |
| WO | WO 01/13461 | | 2/2001 |
| WO | WO 01/69724 | | 9/2001 |
| WO | WO 02/07258 | A2 | 1/2002 |
| WO | WO 02/07258 | A3 | 1/2002 |
| WO | WO 02/25967 | | 3/2002 |
| WO | WO 03/079484 | | 9/2003 |
| WO | WO 03/081718 | | 10/2003 |
| WO | WO 2004/051798 | | 6/2004 |
| WO | WO 2006/023247 | | 3/2006 |
| WO | WO 2006/057679 | | 6/2006 |
| WO | WO 2007/076105 | | 7/2007 |
| WO | WO 2007/127087 | | 11/2007 |
| WO | WO 2013/119750 | | 8/2013 |
| WO | WO 2013/152027 | | 10/2013 |

OTHER PUBLICATIONS

Abramov 2003—P.R. 3-3 © Chart for U.S. Patent No. 7,525,486 and U.S. Patent No. 7,193,562.
Abramov 273—P.R. 3-3 © Chart for U.S. Patent No. 7,525,486 and U.S. Patent No. 7,193,562.
Abramov 296—P.R. 3-3 © Chart for U.S. Patent No. 7,525,486 and U.S. Patent No. 7,193,562.
Airgain 2004—P.R. 3-3 © Chart for U.S. Patent No. 7,525,486 and U.S. Patent No. 7,193,562.
Bancroft 863—P.R. 3-3 © Chart for U.S. Patent No. 7,525,486 and U.S. Patent No. 7,193,562.
Barabash 059—P.R. 3-3 © Chart for U.S. Patent No. 7,525,486 and U.S. Patent No. 7,193,562.
Cetiner 2003—P.R. 3-3 © Chart for U.S. Patent No. 7,525,486 and U.S. Patent No. 7,193,562.
Chuang 2003—P.R. 3-3 © Chart for U.S. Patent No. 7,525,486 and U.S. Patent No. 7,193,562.
Evans 864—P.R. 3-3 © Chart for U.S. Patent No. 7,525,486.
Johnson 404—P.R. 3-3 © Chart for U.S. Patent No. 7,525,486 and U.S. Patent No. 7,193,562.
Kalis 2000—P.R. 3-3 © Chart for U.S. Patent No. 7,525,486 and U.S. Patent No. 7,193,562.
Kalis 2002—P.R. 3-3 © Chart for U.S. Patent No. 7,525,486.
Kaluzni 717—P.R. 3-3 © Chart for U.S. Patent No. 7,525,486 and U.S. Patent No. 7,193,562.
Kim 693—P.R. 3-3 © Chart for U.S. Patent No. 7,525,486 and U.S. Patent No. 7,193,562.
Lin 836—P.R. 3-3 © Chart for U.S. Patent No. 7,525,486 and U.S. Patent No. 7,193,562.
Nakao 762—P.R. 3-3 © Chart for U.S. Patent No. 7,525,486.
Okada 201—P.R. 3-3 © Chart for U.S. Patent No. 7,525,486 and U.S. Patent No. 7,193,562.
Palmer 773—P.R. 3-3 © Chart for U.S. Patent No. 7,525,486 and U.S. Patent No. 7,193,562.
Paun 749—P.R. 3-3 © Chart for U.S. Patent No. 7,525,486 and U.S. Patent No. 7,193,562.
Qian 2000—P.R. 3-3 © Chart for U.S. Patent No. 7,525,486 and U.S. Patent No. 7,193,562.
Shehab 2003—P.R. 3-3 © Chart for U.S. Patent No. 7,525,486 and U.S. Patent No. 7,193,562.
Shirosaka 907—P.R. 3-3 © Chart for U.S. Patent No. 7,525,486 and U.S. Patent No. 7,193,562.
Shtrom 198 & 280—P.R. 3-3 © Chart for U.S. Patent No. 7,525,486 and U.S. Patent No. 7,193,562.
Sievenpiper 254—P.R. 3-3 © Chart for U.S. Patent No. 7,525,486 and U.S. Patent No. 7,193,562.
Simons 1994—P.R. 3-3 © Chart for U.S. Patent No. 7,525,486 and U.S. Patent No. 7,193,562.
Sward 643—P.R. 3-3 © Chart for U.S. Patent No. 7,525,486 and U.S. Patent No. 7,193,562.
Vaughan 1995—P.R. 3-3 © Chart for U.S. Patent No. 7,525,486 and U.S. Patent No. 7,193,562.
Wang 703—P.R. 3-3 © Chart for U.S. Patent No. 7,525,486 and U.S. Patent No. 7,193,562.
Alard, M., et al., "Principles of Modulation and Channel Coding for Digital Broadcasting for Mobile Receivers," 8301 EBU Review Technical, Aug. 1987, No. 224, Brussels, Belgium.
Ando et al., "Study of Dual-Polarized Omni-Directional Antennas for 5.2 GHz-Band 2×2 MIMO-OFDM Systems," Antennas and Propogation Society International Symposium, 2004, IEEE, pp. 1740-1743 vol. 2.
Areg Alimian et al., "Analysis of Roaming Techniques," doc.:IEEE 802.11-04/0377r1, Submission, Mar. 2004.
"Authorization of Spread Spectrum Systems Under Parts 15 and 90 of the FCC Rules and Regulations," Rules and Regulations Federal Communications Commission, 47 CFR Part 2, 15 and 90, Jun. 18, 1985.
"Authorization of spread spectrum and other wideband emissions not presently provided for in the FCC Rules and Regulations," Before the Federal Communications Commission, FCC 81-289, 87 F.C.C.2d 876, Gen Docket No. 81-413, Jun. 30, 1981.
Bedell, Paul, "Wireless Crash Course," 2005, p. 84, The McGraw-Hill Companies, Inc., USA.
Behdad et al., Slot Antenna Miniaturization Using Distributed Inductive Loading, Antenna and Propagation Society International Symposium, 2003 IEEE, vol. 1, pp. 308-311 (Jun. 2003).
Berenguer, Inaki, et al., "Adaptive MIMO Antenna Selection," Nov. 2003.
Casas, Eduardo F., et al., "OFDM for Data Communication Over Mobile Radio FM Channels—Part I: Analysis and Experimental Results," IEEE Transactions on Communications, vol. 39, No. 5, May 1991, pp. 783-793.
Casas, Eduardo F., et al., "OFDM for Data Communication over Mobile Radio FM Channels; Part II: Performance Improvement," Department of Electrical Engineering, University of British Columbia.
Chang, Nicholas B. et al., "Optimal Channel Probing and Transmission Scheduling for Opportunistics Spectrum Access," Sep. 2007.

(56) References Cited

OTHER PUBLICATIONS

Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.
Chang, Robert W., "Synthesis of Band-Limited Orthogonal Signals for Multichannel Data Transmission," The Bell System Technical Journal, Dec. 1966, pp. 1775-1796.C.
Chuang et al., a 2.4 GHz Polarization-diversity Planar Printed Dipole Antenna for WLAN and Wireless Communication Applications, Microwave Journal, vol. 45, No. 6, pp. 50-62 (Jun. 2002).
Cimini, Jr., Leonard J, "Analysis and Simulation of a Digital Mobile Channel Using Orthogonal Frequency Division Multiplexing," IEEE Transactions on Communications, vol. Com-33, No. 7, Jul. 1985, pp. 665-675.
Cisco Systems, "Cisco Aironet Access Point Software Configuration Guide: Configuring Filters and Quality of Service," Aug. 2003.
Dell Inc., "How Much Broadcast and Multicast Traffic Should I Allow in My Network," PowerConnect Application Note #5, Nov. 2003.
Dutta, Ashutosh et al., "MarconiNet Supporting Streaming Media Over Localized Wireless Multicast," Proc. of the 2d Int'l Workshop on Mobile Commerce, 2002.
Dunkels, Adam et al., "Making TCP/IP Viable for Wireless Sensor Networks," Proc. of the 1st Euro. Workshop on Wireless Sensor Networks, Berlin, Jan. 2004.
Dunkels, Adam et al., "Connecting Wireless Sensornets with TCP/IP Networks," Proc. of the 2d Int'l Conf. on Wired Networks, Frankfurt, Feb. 2004.
English Translation of PCT Pub. No. WO2004/051798 (as filed US National Stage U.S. Appl. No. 10/536,547).
Festag, Andreas, "What is MOMBASA?" Telecommunication Networks Group (TKN), Technical University of Berlin, Mar. 7, 2002.
Frederick et al., Smart Antennas Based on Spatial Multiplexing of Local Elements (SMILE) for Mutual Coupling Reduction, IEEE Transactions of Antennas and Propogation, vol. 52., No. 1, pp. 106-114 (Jan. 2004).
Gaur, Sudhanshu, et al., "Transmit/Receive Antenna Selection for MIMO Systems to Improve Error Performance of Linear Receivers," School of ECE, Georgia Institute of Technology, Apr. 4, 2005.
Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.
Golmie, Nada, "Coexistence in Wireless Networks: Challenges and System-Level Solutions in the Unlicensed Bands," Cambridge University Press, 2006.
Hewlett Packard, "HP ProCurve Networking: Enterprise Wireless LAN Networking and Mobility Solutions," 2003.
Hirayama, Koji et al., "Next-Generation Mobile-Access IP Network," Hitachi Review vol. 49, No. 4, 2000.
Ian F. Akyildiz, et al., "A Virtual Topology Based Routing Protocol for Multihop Dynamic Wireless Networks," Broadband and Wireless Networking Lab, School of Electrical and Computer Engineering, Georgia Institute of Technology.
Information Society Technologies Ultrawaves, "System Concept / Architecture Design and Communication Stack Requirement Document," Feb. 23, 2004.
Ken Tang, et al., "MAC Layer Broadcast Support in 802.11 Wireless Networks," Computer Science Department, University of California, Los Angeles, 2000 IEEE, pp. 544-548.
Ken Tang, et al., "MAC Reliable Broadcast in Ad Hoc Networks," Computer Science Department, University of California, Los Angeles, 2001 IEEE, pp. 1008-1013.
Mawa, Rakesh, "Power Control in 3G Systems," Hughes Systique Corporation, Jun. 28, 2006.
Microsoft Corporation, "IEEE 802.11 Networks and Windows XP," Windows Hardware Developer Central, Dec. 4, 2001.
Molisch, Andreas F., et al., "MIMO Systems with Antenna Selection—an Overview," Draft, Dec. 31, 2003.
Moose, Paul H., "Differential Modulation and Demodulation of Multi-Frequency Digital Communications Signals," 1990 IEEE,CH2831-6/90/0000-0273.
Orinoco AP-2000 5GHz Kit, "Access Point Family," Proxim Wireless Corporation.
Pat Calhoun et al., "802.11r strengthens wireless voice," Technology Update, Network World, Aug. 22, 2005, http://www.networkworld.com/news/tech/2005/082208techupdate.html.
Press Release, NETGEAR RangeMax(TM) Wireless Networking Solutions Incorporate Smart MIMO Technology to Eliminate Wireless Dead Spots and Take Consumers Farther, Ruckus Wireles Inc. (Mar. 7, 2005), available at http://ruckuswireless.com/press/releases/20050307.php.
RL Miller, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.
Sadek, Mirette, et al., "Active Antenna Selection in Multiuser MIMO Communications," IEEE Transactions on Signal Processing, vol. 55, No. 4, Apr. 2007, pp. 1498-1510.
Saltzberg, Burton R., "Performance of an Efficient Parallel Data Transmission System," IEEE Transactions on Communication Technology, vol. Com-15, No. 6, Dec. 1967, pp. 805-811.
Steger, Christopher et al., "Performance of IEEE 802.11b Wireless LAN in an Emulated Mobile Channel," 2003.
Toskala, Antti, "Enhancement of Broadcast and Introduction of Multicast Capabilities in RAN," Nokia Networks, Palm Springs, California, Mar. 13-16, 2001.
Tsunekawa, Kouichi, "Diversity Antennas for Portable Telephones," 39th IEEE Vehicular Technology Conference, pp. 50-56, vol. I, Gateway to New Concepts in Vehicular Technology, May 1-3, 1989, San Francisco, CA.
Varnes et al., A Switched Radial Divider for an L-Band Mobile Satellite Antenna, European Microwave Conference (Oct. 1995), pp. 1037-1041.
Vincent D. Park, et al., "A Performance Comparison of the Temporally-Ordered Routing Algorithm and Ideal Link-State Routing," IEEE, Jul. 1998, pp. 592-598.
W.E. Doherty, Jr. et al., The Pin Diode Circuit Designer's Handbook (1998).
Weinstein, S. B., et al.,"Data Transmission by Frequency-Division Multiplexing Using the Discrete Fourier Transform," IEEE Transactions on Communication Technology, vol. Com-19, No. 5, Oct. 1971, pp. 628-634.
Wennstrom, Mattias et al., "Transmit Antenna Diversity in Ricean Fading MIMO Channels with Co-Channel Interference," 2001.
Petition Decision Denying Request to Order Additional Claims for U.S. Patent No. 7,193,562 (Control No. 95/001078) mailed on Jul. 10, 2009.
Right of Appeal Notice for U.S. Patent No. 7,193,562 (Control No. 95/001078) mailed on Jul. 10, 2009.
European Examination Report for EP Application No. 05776697.4 mailed Jan. 21, 2011.
European Second Examination Report for EP Application No. 07775498.4 dated Mar. 12, 2013
European Third Examination Report for EP Application No. 07775498.4 dated Oct. 17, 2011.
European First Examination Report for EP Application No. 09014989.9 dated May 7, 2012.
Supplementary European Search Report for EP Application No. EP05776697.4 dated Jul. 10, 2009.
Supplementary European Search Report for EP Application No. EP07755519 dated Mar. 11, 2009.
PCT Application No. PCT/US2005/27023, International Search Report and Written Opinion mailed Dec. 23, 2005.
PCT Application No. PCT/US2006/49211, International Search Report and Written Opinion mailed Aug. 29, 2008.
PCT Application No. PCT/US2007/09276, International Search Report and Written Opinion mailed Aug. 11, 2008.
Chinese Application No. 200680048001.7, Office Action dated Jun, 20, 2012.
Chinese Application No. 200780020943.9, Office Action dated Feb. 7, 2013.

(56) References Cited

OTHER PUBLICATIONS

Chinese Application No. 200780020943.9, Office Action dated Aug. 29, 2012.
Chinese Application No. 200780020943.9, Office Action dated Dec. 19, 2011.
Chinese Application No. 200910258884.X, Office Action dated Aug. 3, 2012.
Taiwan Application No. 094127953, Office Action dated Mar. 20, 2012.
Taiwan Application No. 096114265, Office Action dated Jun. 20, 2011.
U.S. Appl. No. 11/010,076, Office Action mailed Oct. 31, 2006.
U.S. Appl. No. 11/010,076, Final Office Action mailed Aug. 8, 2006.
U.S. Appl. No. 11/010,076, Office Action mailed Dec. 23, 2006.
U.S. Appl. No. 11/022,080, Office Action mailed Jul. 21, 2006.
U.S. Appl. No. 11/041,145, Final Office Action mailed Jan. 29, 2007.
U.S. Appl. No. 11/041,145, Office Action mailed Jul. 21, 2006.
U.S. Appl. No. 11/265,751, Office Action mailed Mar. 18, 2008.
U.S. Appl. No. 11/413,461, Office Action mailed Jun. 7, 2007.
U.S. Appl. No. 11/714,707, Final Office Action mailed May 30, 2008.
U.S. Appl. No. 11/714,707, Office Action mailed Oct. 15, 2007.
U.S. Appl. No. 12/082,090, Office Action mailed Jan. 18, 2011.
U.S. Appl. No. 12/404,124, Final Office Action mailed Feb. 7, 2012.
U.S. Appl. No. 12/404,124, Office Action mailed Sep. 19, 2011.
U.S. Appl. No. 12/953,324, Office Action mailed Mar. 24, 2011.
U.S. Appl. No. 13/305,609, Final Office Action mailed Jul. 3,2012.
U.S. Appl. No. 13/305,609, Office Action mailed Dec. 20, 2011.
U.S. Appl. No. 13/485,012, Final Office Action mailed Mar. 3, 2013.
U.S. Appl. No. 13/485,012, Office Action mailed Oct. 25, 2012.
Encrypted Preshared key: Cisco Corp., 14 pages, 2010.
PCT Application No. PCT/US2013/034997, International Search Report mailed Jun. 17, 2013.
U.S. Appl. No. 11/877,465, Office Action mailed Sep. 19, 2011.
U.S. Appl. No. 12/980,253, Office Action mailed Sep. 13, 2011.
Encrypted Preshared key; cisco corp. 14 pages, 2010.
Request for Inter Partes Rexamination for U.S. Patent No. 7,358,912, filed by Rayspan Corporation and Netgear, Inc. on Sep. 4, 2008.
Third Party Comments after Patent Owner's Response in Accordance with 37 CFR 1.947 for U.S. Patent No. 7,358,912 (Control No. 95/001079) mailed on Jul. 17, 2009.
U.S. Appl. No. 95/001,078, Sep. 4, 2008, Shtrom et al. (Re-Exam).
U.S. Appl. No. 95/001,079, Sep. 4, 2008, Shtrom et al. (Re-Exam).
PCT Application No. PCT/US2005/027169, International Search Report and Written Opinion mailed Aug. 10, 2006.
PCT Application No. PCT/US2013/34997, International Search Report mailed Jun. 17, 2013.
Chinese Application No. 20058001532.6, Office Action dated Jun. 23, 2011.
Chinese Application No. 200910258884.X, Office Action dated Apr. 15, 2013.
Taiwan Application No. 094127953, Office Action dated Aug. 16, 2011.
U.S. Appl. No. 12/404,127, Final Office Action mailed Feb. 7, 2012.
U.S. Appl. No. 12/404,127, Office Action mailed Sep. 19, 2011.
U.S. Appl. No. 11/877,465, Final Office Action mailed May 16, 2013.
U.S. Appl. No. 11/877,465, Office Action mailed Oct. 3, 2012.
U.S. Appl. No. 11/877,465, Final Office Action mailed Jun. 20, 2012.
U.S. Appl. No. 11/877,465, Final Office Action mailed Dec. 9, 2010.
U.S. Appl. No. 11/877,465, Office Action mailed Apr. 12, 2010.
U.S. Appl. No. 12/980,253, Final Office Action mailed Jun. 6, 2013.
U.S. Appl. No. 12/980,253, Office Action mailed Aug. 17, 2012.
U.S. Appl. No. 12/980,253, Office Action mailed Mar. 1, 2011.
U.S. Appl. No. 11/924,082, Office Action mailed Aug. 29, 2008.
U.S. Appl. No. 12/425,374, Office Action mailed Jul. 6, 2010.
U.S. Appl. No. 13/653,405, Office Action mailed Dec. 19, 2012.
U.S. Appl. No. 13/731,273, Office Action mailed May 23, 2013.
U.S. Appl. No. 13/396,482, Office Action mailed Oct. 18, 2013.
U.S. Appl. No. 13/396,484, Office Action mailed Oct. 11, 2013.
U.S. Appl. No. 13/370,201, Office Action mailed May 13, 2013.
U.S. Appl. No. 13/439,844, Final Office Action mailed Oct. 28, 2013.
U.S. Appl. No. 13/439,844, Office Action mailed Jun. 5, 2013.
Bargh et al., "Fast Authentication Methods for Handovers between IEEE 802.11 Wireless LANs", Proceedings of the ACM International Workshop on Wireless Mobile Applications and Services on WLAN Hotspots. Oct. 1, 2004.
Kassab et al., "Fast Pre-Authentication Based on Proactive Key Distribution for 802.11 Infrastructure Networks", WMuNeP'05, Oct. 13, 2005, Montreal, Quebec, Canada, Copyright 2005 ACM.
European Second Examination Report for EP Application No. 09014989.9 dated Dec. 13, 2013.
U.S. Appl. No. 13/653,405, Office Action mailed Dec. 19, 2013.

* cited by examiner

COVERAGE ANTENNA APPARATUS WITH SELECTABLE HORIZONTAL AND VERTICAL POLARIZATION ELEMENTS

CROSS-REFERENCE TO RELATED APPLICATIONS

This application is a continuation and claims the priority benefit of U.S. patent application Ser. No. 12/082,090, filed Apr. 7, 2008, which is a continuation and claims the priority benefit of U.S. patent application Ser. No. 11/413,461, filed Apr. 28, 2006, now U.S. Pat. No. 7,358,912, which claims the priority benefit of U.S. provisional patent application No. 60/694,101, filed Jun. 24, 2005, the disclosures of which are incorporated herein by reference.

This application is related to and incorporates by reference U.S. patent application Ser. No. 11/041,145, filed Jan. 21, 2005; U.S. patent application Ser. No. 11/022,080, filed Dec. 23, 2004; U.S. patent application Ser. No. 11/010,076, filed Dec. 9, 2004; U.S. patent application Ser. No. 11/180,329, filed Jul. 12, 2005; and U.S. patent application Ser. No. 11/190,288, filed Jul. 26, 2005.

BACKGROUND OF INVENTION

1. Field of the Invention

The present invention relates generally to wireless communications, and more particularly to an antenna apparatus with selectable horizontal and vertical polarization elements.

2. Description of the Prior Art

In communications systems, there is an ever-increasing demand for higher data throughput and a corresponding drive to reduce interference that can disrupt data communications. For example, in an IEEE 802.11 network, an access point (i.e., base station) communicates data with one or more remote receiving nodes or stations, e.g., a network interface card of a laptop computer, over a wireless link. The wireless link may be susceptible to interference from other access points and stations, other radio transmitting devices, changes or disturbances in the wireless link environment between the access point and the remote receiving node, and so on. The interference may be such to degrade the wireless link, for example by forcing communication at a lower data rate, or may be sufficiently strong to completely disrupt the wireless link.

One method for reducing interference in the wireless link between the access point and the remote receiving node is to provide several omnidirectional antennas, in a "diversity" scheme. For example, a common configuration for the access point comprises a data source coupled via a switching network to two or more physically separated omnidirectional antennas. The access point may select one of the omnidirectional antennas by which to maintain the wireless link. Because of the separation between the omnidirectional antennas, each antenna experiences a different signal environment, and each antenna contributes a different interference level to the wireless link. The switching network couples the data source to whichever of the omnidirectional antennas experiences the least interference in the wireless link. However, one problem with using two or more omnidirectional antennas for the access point is that typical omnidirectional antennas are vertically polarized. Vertically polarized radio frequency (RF) energy does not travel as efficiently as horizontally polarized RF energy inside a typical office or dwelling space. Typical horizontally polarized RF antennas to date have been expensive to manufacture, or do not provide adequate RF performance to be commercially successful.

A further problem is that the omnidirectional antenna typically comprises an upright wand attached to a housing of the access point. The wand typically comprises a hollow metallic rod exposed outside of the housing, and may be subject to breakage or damage. Another problem is that each omnidirectional antenna comprises a separate unit of manufacture with respect to the access point, thus requiring extra manufacturing steps to include the omnidirectional antennas in the access point. Yet another problem is that the access point with the typical omnidirectional antennas is a relatively large physically, because the omnidirectional antennas extend from the housing.

A still further problem with the two or more omnidirectional antennas is that because the physically separated antennas may still be relatively close to each other, each of the several antennas may experience similar levels of interference and only a relatively small reduction in interference may be gained by switching from one omnidirectional antenna to another omnidirectional antenna.

Another method to reduce interference involves beam steering with an electronically controlled phased array antenna. However, the phased array antenna can be extremely expensive to manufacture. Further, the phased array antenna can require many phase tuning elements that may drift or otherwise become maladjusted.

SUMMARY OF THE INVENTION

In one aspect, a system comprises a communication device configured to generate or receive a radio frequency (RF) signal, an antenna apparatus configured to radiate or receive the RF signal, and an antenna element selector. The antenna apparatus includes a first planar element configured to radiate or receive the RF signal in a horizontal polarization and a second planar element configured to radiate or receive the RF signal in a vertical polarization. The antenna element selector is configured to couple the RF signal to the first planar element or the second planar element.

In some embodiments, the antenna apparatus is configured to radiate or receive the RF signal in a diagonal polarization if the first planar element and the second planar element are coupled to the RF signal. The antenna apparatus may be configured to radiate or receive the RF signal in a substantially omnidirectional radiation pattern. The first planar element may comprise a slot antenna and the second planar element may comprise a dipole. The antenna element selector may comprise a PIN diode network configured to couple the RF signal to the first planar element or the second planar element.

In one aspect, an antenna apparatus comprises a first substrate including a first planar element and a second planar element. The first planar element is configured to radiate or receive a radio frequency (RF) signal in a horizontal polarization. The second planar element is configured to radiate or receive the RF signal in a vertical polarization.

In some embodiments, the first planar element and the second planar element comprise a circuit board. The antenna apparatus may comprise a second substrate including a third planar element coupled substantially perpendicularly to the circuit board. The second substrate may be coupled to the circuit board by solder.

In one aspect, a method of manufacturing an antenna apparatus comprises forming a first antenna element and a second antenna element from a printed circuit board substrate, partitioning the printed circuit board substrate into a first portion including the first antenna element and a second portion including the second antenna element and coupling the first portion to the second portion to form a non-planar antenna apparatus. Coupling the first portion to the second portion may comprise soldering the first portion to the second portion.

In one aspect, a system comprises a housing, a communication device, and an antenna apparatus including one or more slot antennas integral with the housing. One or more of the slot antennas may comprise loading elements configured to decrease a footprint of the slot antenna. One or more of the slot antennas may comprise an aperture formed in the housing.

BRIEF DESCRIPTION OF DRAWINGS

The present invention will now be described with reference to drawings that represent a preferred embodiment of the invention. In the drawings, like components have the same reference numerals. The illustrated embodiment is intended to illustrate, but not to limit the invention. The drawings include the following figures.

DETAILED DESCRIPTION

Figure 1:
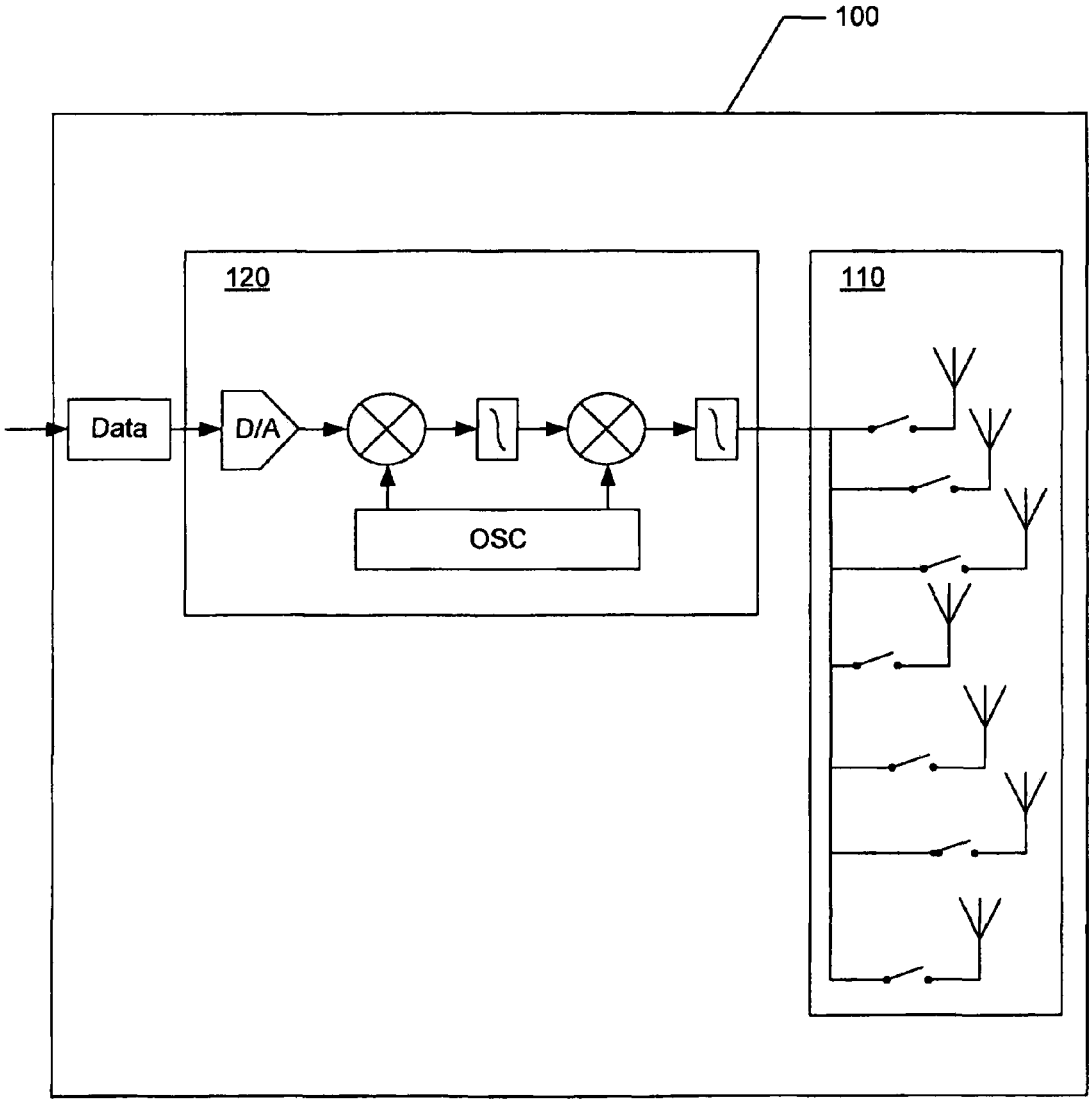
FIG. 1 illustrates a system comprising an antenna apparatus with selectable horizontal and vertical polarization elements, in one embodiment in accordance with the present invention.

A system for a wireless (i.e., radio-frequency or RF) link to a remote receiving node includes a communication device for generating an RF signal and an antenna apparatus for transmitting and/or receiving the RF signal. The antenna apparatus comprises a plurality of modified dipoles (also referred to herein as simply "dipoles") and/or a plurality of modified slot antennas (also referred to herein as simply "slots"). In a preferred embodiment, the antenna apparatus includes a number of slots configured to transmit and/or receive horizontal polarization, and a number of dipoles to provide vertical polarization. Each dipole and each slot provides gain (with respect to isotropic) and a polarized directional radiation pattern. The slots and the dipoles may be arranged with respect to each other to provide offset radiation patterns.

In some embodiments, the dipoles and the slots comprise individually selectable antenna elements and each antenna element may be electrically selected (e.g., switched on or off) so that the antenna apparatus may form a configurable radiation pattern. An antenna element selector is included with or coupled to the antenna apparatus so that one or more of the individual antenna elements may be selected or active. If certain or all elements are switched on, the antenna apparatus forms an omnidirectional radiation pattern, with both vertically polarized and horizontally polarized (also referred to herein as diagonally polarized) radiation. For example, if two or more of the dipoles are switched on, the antenna apparatus may form a substantially omnidirectional radiation pattern with vertical polarization. Similarly, if two or more of the slots are switched on, the antenna apparatus may form a substantially omnidirectional radiation pattern with horizontal polarization.

The antenna apparatus is easily manufactured from common planar substrates such as an FR4 printed circuit board (PCB). The PCB may be partitioned into portions including one or more elements of the antenna apparatus, which portions may then be arranged and coupled (e.g., by soldering) to form a non-planar antenna apparatus having a number of antenna elements.

In some embodiments, the slots may be integrated into or conformally mounted to a housing of the system, to minimize cost and size of the system, and to provide support for the antenna apparatus.

Advantageously, a controller of the system may select a particular configuration of antenna elements and a corresponding configurable radiation pattern that minimizes interference over the wireless link to the remote receiving node. If the wireless link experiences interference, for example due to other radio transmitting devices, or changes or disturbances in the wireless link between the system and the remote receiving node, the system may select a different combination of selected antenna elements to change the corresponding radiation pattern and minimize the interference. The system may select a configuration of selected antenna elements corresponding to a maximum gain between the system and the remote receiving node. Alternatively, the system may select a configuration of selected antenna elements corresponding to less than maximal gain, but corresponding to reduced interference in the wireless link.

FIG. 1 illustrates a system 100 comprising an antenna apparatus 110 with selectable horizontal and vertical polarization elements, in one embodiment in accordance with the present invention. The system 100 may comprise, for example without limitation, a transmitter and/or a receiver, such as an 802.11 access point, an 802.11 receiver, a set-top box, a laptop computer, a television, a PCMCIA card, a remote control, a Voice Over Internet telephone, and a remote terminal such as a handheld gaming device.

In some exemplary embodiments, the system 100 comprises an access point for communicating to one or more remote receiving nodes (not shown) over a wireless link, for example in an 802.11 wireless network. Typically, the system 100 may receive data from a router connected to the Internet (not shown), and the system 100 may transmit the data to one or more of the remote receiving nodes. The system 100 may also form a part of a wireless local area network by enabling communications among several remote receiving nodes. Although the disclosure will focus on a specific embodiment for the system 100, aspects of the invention are applicable to a wide variety of appliances, and are not intended to be limited to the disclosed embodiment. For example, although the system 100 may be described as transmitting to the remote receiving node via the antenna apparatus, the system 100 may also receive data from the remote receiving node via the antenna apparatus.

The system 100 includes a communication device 120 (e.g., a transceiver) and an antenna apparatus 110. The communication device 120 comprises virtually any device for generating and/or receiving an RF signal. The communication device 120 may include, for example, a radio modulator/demodulator for converting data received into the system 100 (e.g., from the router) into the RF signal for transmission to one or more of the remote receiving nodes. In some embodiments, the communication device 120 comprises well-known circuitry for receiving data packets of video from the router and circuitry for converting the data packets into 802.11 compliant RF signals.

As described further herein, the antenna apparatus 110 comprises a plurality of antenna elements including a plurality of dipoles and/or a plurality of slots. The dipoles are configured to generate vertical polarization, and the slots are configured to generate horizontal polarization. Each of the antenna elements provides gain (with respect to isotropic).

In embodiments with individually selectable antenna elements, each antenna element may be electrically selected (e.g., switched on or off) so that the antenna apparatus 110 may form a configurable radiation pattern. The antenna apparatus 110 may include an antenna element selecting device configured to selectively couple one or more of the antenna elements to the communication device 120. By selectively coupling one or more of the antenna elements to the communication device 120, the system 100 may transmit/receive with horizontal polarization, vertical polarization, or diagonal polarization. Further, the system 100 may also transmit/receive with configurable radiation patterns ranging from highly directional to substantially omnidirectional, depending upon which of the antenna elements are coupled to the communication device 120.

Mechanisms for selecting one or more of the antenna elements are described further in particular in U.S. application Ser. No. 11/180,329, titled "System and Method for Transmission Parameter Control for an Antenna Apparatus with Selectable Elements" filed Jul. 12, 2005; and other applications listed herein and incorporated by reference.

Figure 2:
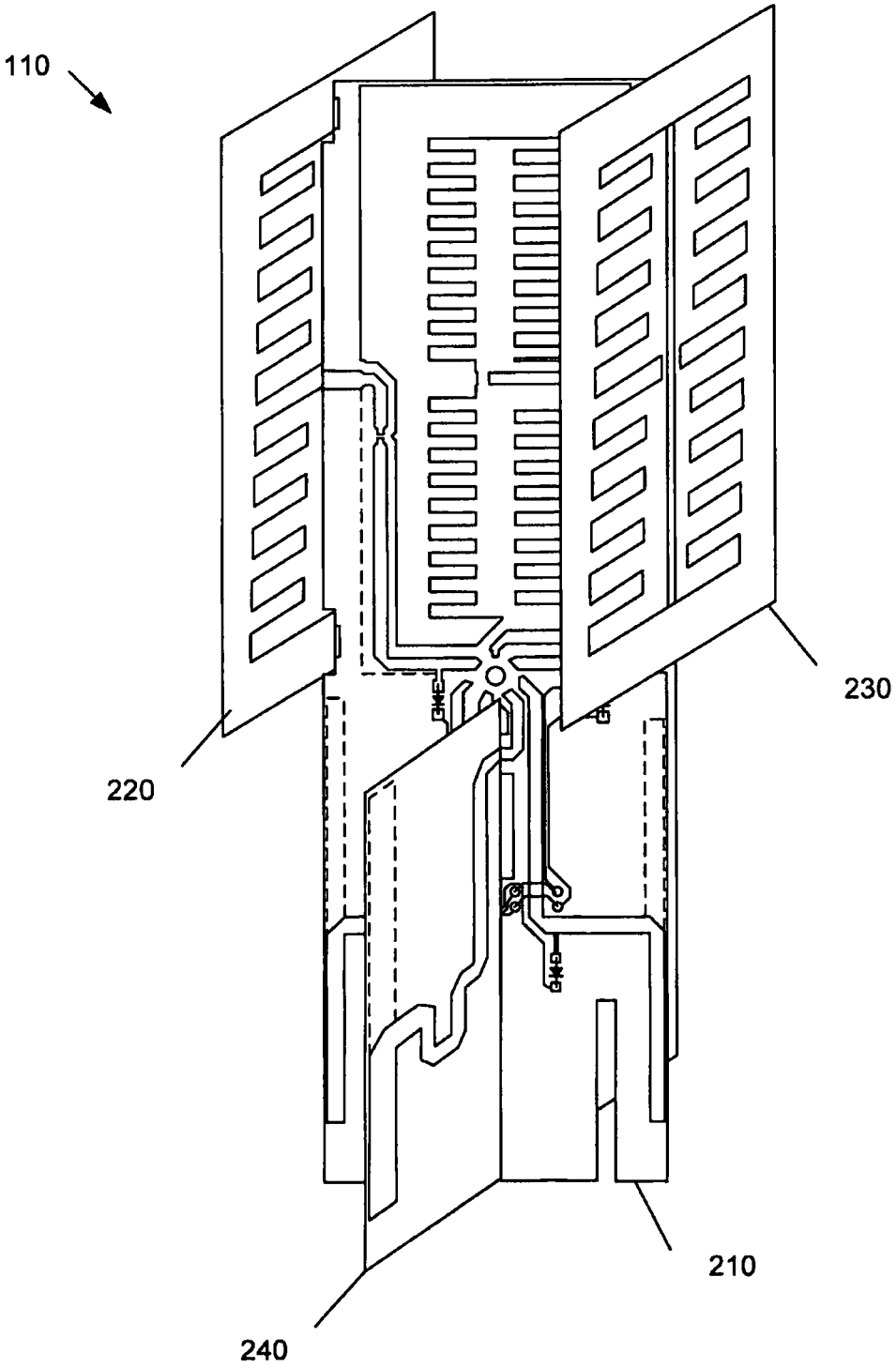
FIG. 2 illustrates the antenna apparatus of FIG. 1, in one embodiment in accordance with the present invention.

FIG. 2 illustrates the antenna apparatus 110 of FIG. 1, in one embodiment in accordance with the present invention. The antenna apparatus 110 of this embodiment includes a first substrate 210 (parallel to the plane of FIG. 2), a second substrate 220 (perpendicular to the plane of FIG. 2), a third substrate 230 (perpendicular to the plane of FIG. 2), and a fourth substrate 240 (perpendicular to the plane of FIG. 2).

As described further with respect to FIG. 3, the first substrate 210 includes a slot, two dipoles, and an antenna element selector (not labeled, for clarity). The second substrate 220 includes a slot antenna perpendicular to and coupled to a first edge of the first substrate 210. The third substrate 230 includes a slot perpendicular to and opposite from the second substrate 220 on the first substrate 210. The fourth substrate 240 includes two dipoles (one of the dipoles is obscured in FIG. 2 by the first substrate 210) and is perpendicular to and coupled to the first substrate 210.

As described further herein, the substrates 210-240 may be partitioned or sectioned from a single PCB. The substrates 210-240 have a first side (depicted as solid lines) and a second side (depicted as dashed lines) substantially parallel to the first side. The substrates 210-240 comprise a PCB such as FR4, Rogers 4003, or other dielectric material.

Figure 3A:
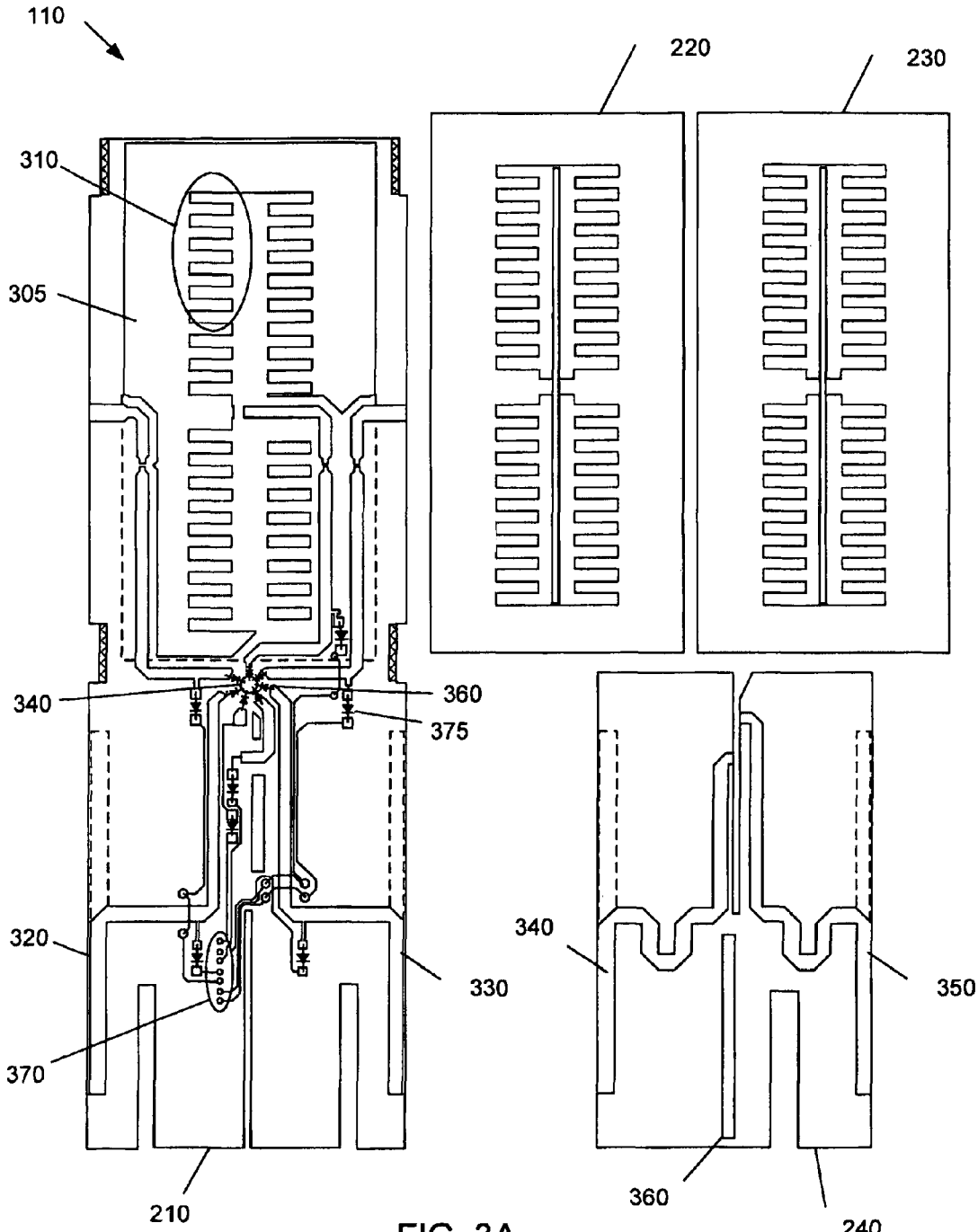
FIG. 3A illustrates PCB components (in solid lines and shading, not to scale) for forming the slots, dipoles, and antenna element selector on the first side of the substrates of FIG. 2, in one embodiment in accordance with the present invention.

FIG. 3A illustrates PCB components (in solid lines and shading, not to scale) for forming the slots, dipoles, and antenna element selector on the first side of the substrates 210-240 of FIG. 2, in one embodiment in accordance with the present invention. PCB components on the second side of the substrates 210-240 (described with respect to FIG. 3B) are shown as dashed lines. Dimensions in mils of the PCB components depicted in FIGS. 3A and 3B (collectively, FIG. 3) are depicted in FIG. 4.

The first side of the substrate 210 includes a portion 305 of a first slot antenna including "fingers" 310 (only a few of the fingers 310 are circled, for clarity), a portion 320 of a first dipole, a portion 330 of a second dipole, and the antenna element selector (not labeled for clarity). The antenna element selector includes a radio frequency feed port 340 for receiving and/or transmitting an RF signal to the communication device 110, and a coupling network (not labeled) for selecting one or more of the antenna elements.

The first side of the substrate 220 includes a portion of a second slot antenna including fingers. The first side of the substrate 230 also includes a portion of a third slot antenna including fingers.

As depicted, to minimize or reduce the size of the antenna apparatus 110, each of the slots includes fingers. The fingers are configured to slow down electrons, changing the resonance of each slot, thereby making each of the slots electrically shorter. At a given operating frequency, providing the fingers allows the overall dimension of the slot to be reduced, and reduces the overall size of the antenna apparatus 110.

The first side of the substrate 240 includes a portion 340 of a third dipole and portion 350 of a fourth dipole. One or more of the dipoles may optionally include passive elements, such as a director 360 (only one director shown for clarity). Directors comprise passive elements that constrain the directional radiation pattern of the modified dipoles, for example to increase the gain of the dipole. Directors are described in more detail in U.S. application Ser. No. 11/010,076 titled "System and Method for an Omnidirectional Planar Antenna Apparatus with Selectable Elements" filed Dec. 9, 2004 and other applications referenced herein and incorporated by reference.

The radio frequency feed port 340 and the coupling network of the antenna element selector are configured to selectively couple the communication device 110 of FIG. 1 to one or more of the antenna elements. It will be apparent to a person or ordinary skill that many configurations of the coupling network may be used to couple the radio frequency feed port 340 to one or more of the antenna elements.

In the embodiment of FIG. 3, the radio frequency feed port 340 is configured to receive an RF signal from and/or transmit an RF signal to the communication device 110, for example by an RF coaxial cable coupled to the radio frequency feed port 340. The coupling network is configured with DC blocking capacitors (not shown) and active RF switches 360 (shown schematically, not all RF switches labeled for clarity) to couple the radio frequency feed port 340 to one or more of the antenna elements.

The RF switches 360 are depicted as PIN diodes, but may comprise RF switches such as GaAs FETs or virtually any RF switching device. The PIN diodes comprise single-pole single-throw switches to switch each antenna element either on or off (i.e., couple or decouple each of the antenna elements to the radio frequency feed port 340). A series of control signals may be applied via a control bus 370 (circled in FIG. 3A) to bias each PIN diode. With the PIN diode forward biased and conducting a DC current, the PIN diode switch is on, and the corresponding antenna element is selected. With the diode reverse biased, the PIN diode switch is off.

In some embodiments, one or more light emitting diodes (LEDs) 375 (not all LED are labeled for clarity) are optionally included in the coupling network as a visual indicator of which of the antenna elements is on or off. A light emitting diode may be placed in circuit with the PIN diode so that the light emitting diode is lit when the corresponding antenna element is selected.

Figure 3B:
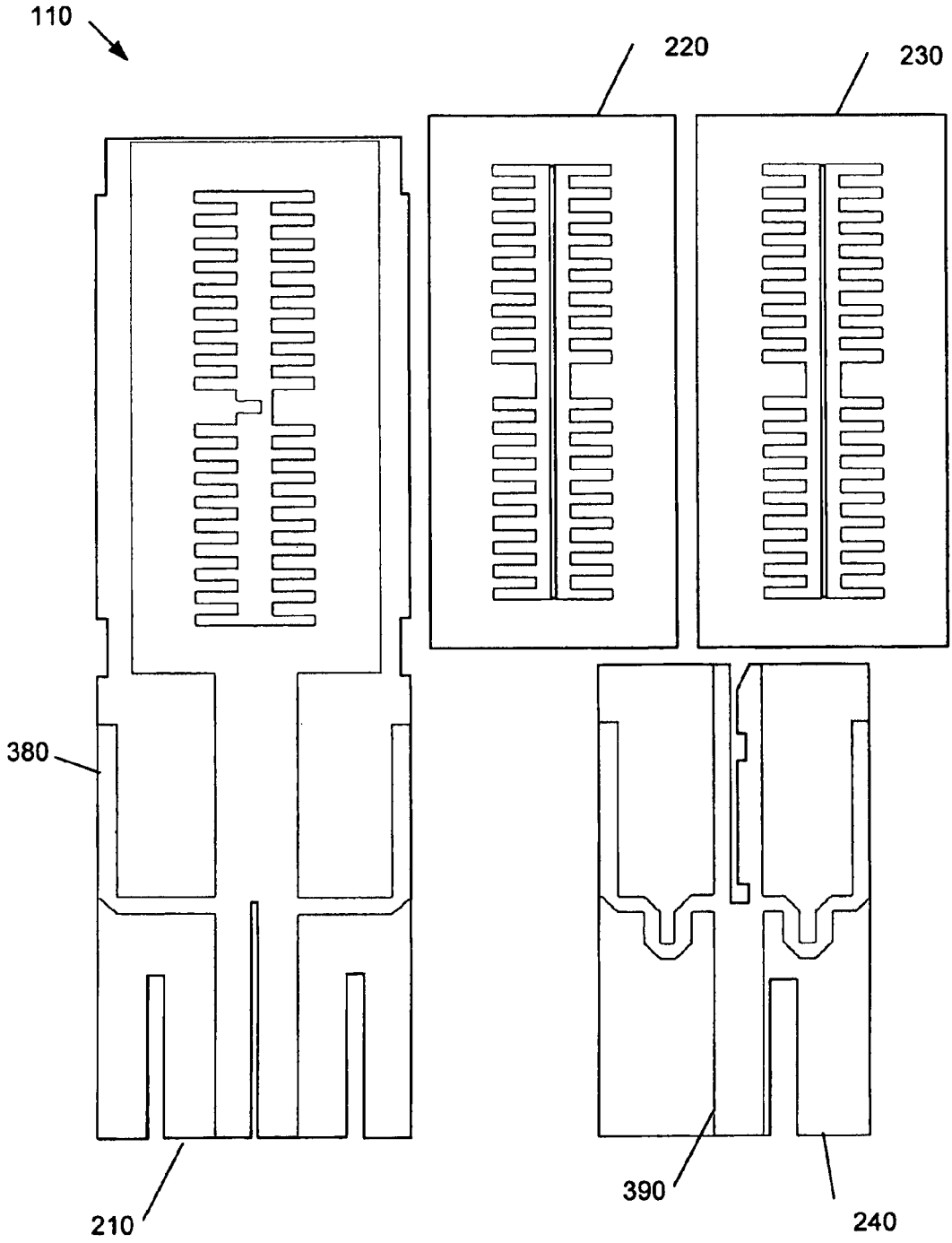
FIG. 3B illustrates PCB components (not to scale) for forming the slots, dipoles, and antenna element selector on the second side of the substrates of FIG. 2 for the antenna apparatus of FIG. 1, in one embodiment in accordance with the present invention.
Figure 4:
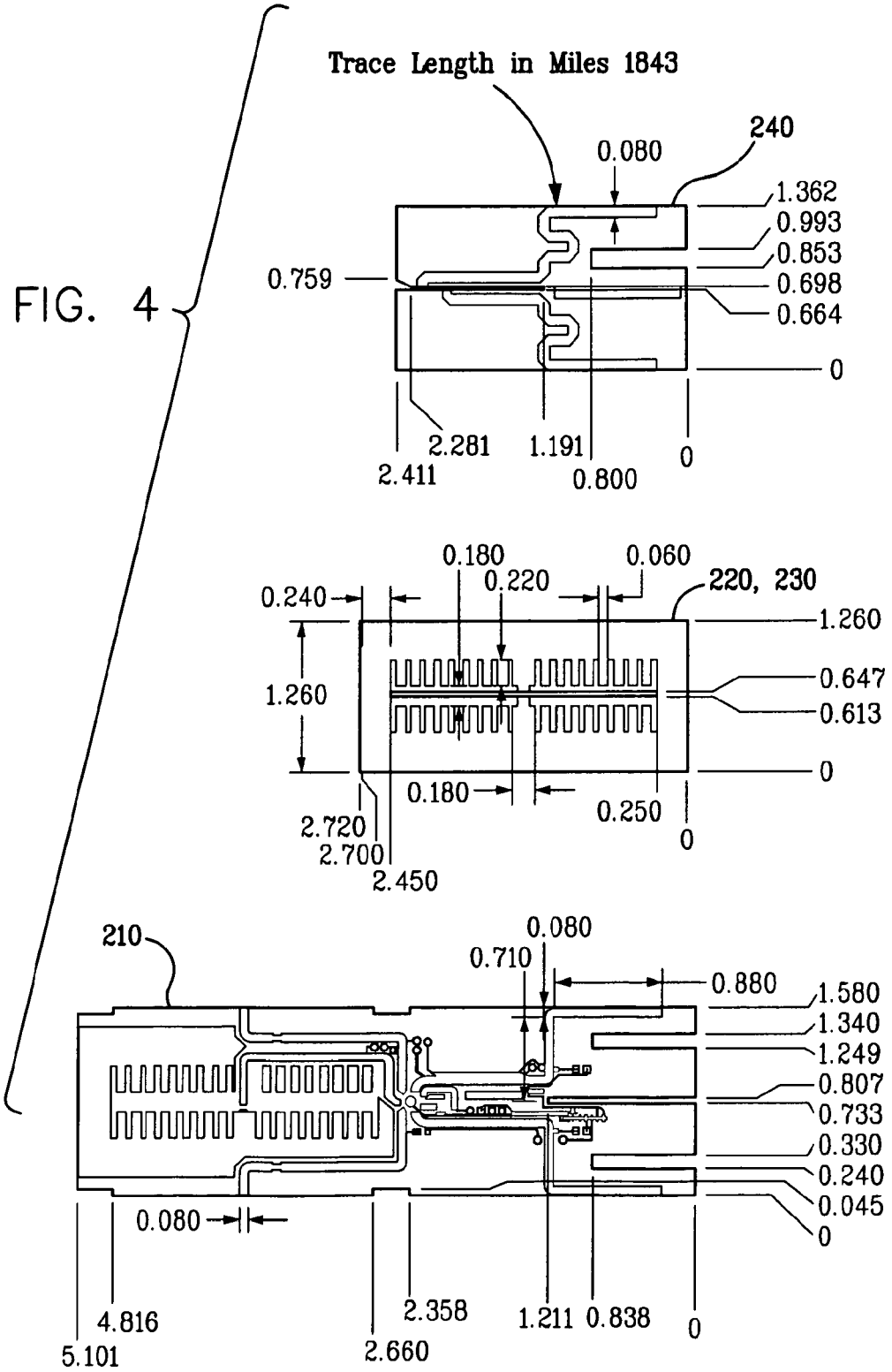
FIG. 4 illustrates various dimensions (in mils) for antenna elements of the antenna apparatus of FIG. 3, in one embodiment in accordance with the present invention.

FIG. 3B illustrates PCB components (not to scale) for forming the slots, dipoles, and antenna element selector on the second side of the substrates 210-240 of FIG. 2 for the antenna apparatus 110 of FIG. 1, in one embodiment in accordance with the present invention. PCB components on the first side of the substrates 210-240 (described with respect to FIG. 3A) are not shown for clarity.

On the second side of the substrates 210-240, the antenna apparatus 110 includes ground components configured to "complete" the dipoles and the slots on the first side of the substrates 210-240. For example, the portion of the dipole 320 on the first side of the substrate 210 (FIG. 3A) is completed by the portion 380 on the second side of the substrate 210 (FIG. 3B). The resultant dipole provides a vertically polarized directional radiation pattern substantially in the plane of the substrate 210.

Optionally, the second side of the substrates 210-240 may include passive elements for modifying the radiation pattern of the antenna' elements. Such passive elements are described in detail in U.S. application Ser. No. 11/010,076 titled "System and Method for an Omnidirectional Planar Antenna Apparatus with Selectable Elements" filed Dec. 9, 2004 and other applications referenced herein and incorporated by reference. For example, the substrate 240 includes a reflector 390 as part of the ground component. The reflector 390 is configured to broaden the frequency response of the dipoles.

FIG. 4 illustrates various dimensions (in mils) for antenna elements of the antenna apparatus 110 of FIG. 3, in one embodiment in accordance with the present invention. It will be appreciated that the dimensions of individual components of the antenna apparatus 110 depend upon a desired operating frequency of the antenna apparatus 110. The dimensions of the individual components may be established by use of RF simulation software, such as IE3D from Zeland Software of Fremont, Calif. For example, the antenna apparatus 110 incorporating the components of dimension according to FIG. 4 is designed for operation near 2.4 GHz, based on a substrate PCB of FR4 material, but it will be appreciated by a person of ordinary skill that a different substrate having different dielectric properties, such as Rogers 4003, may require different dimensions than those shown in FIG. 4.

Figure 5:
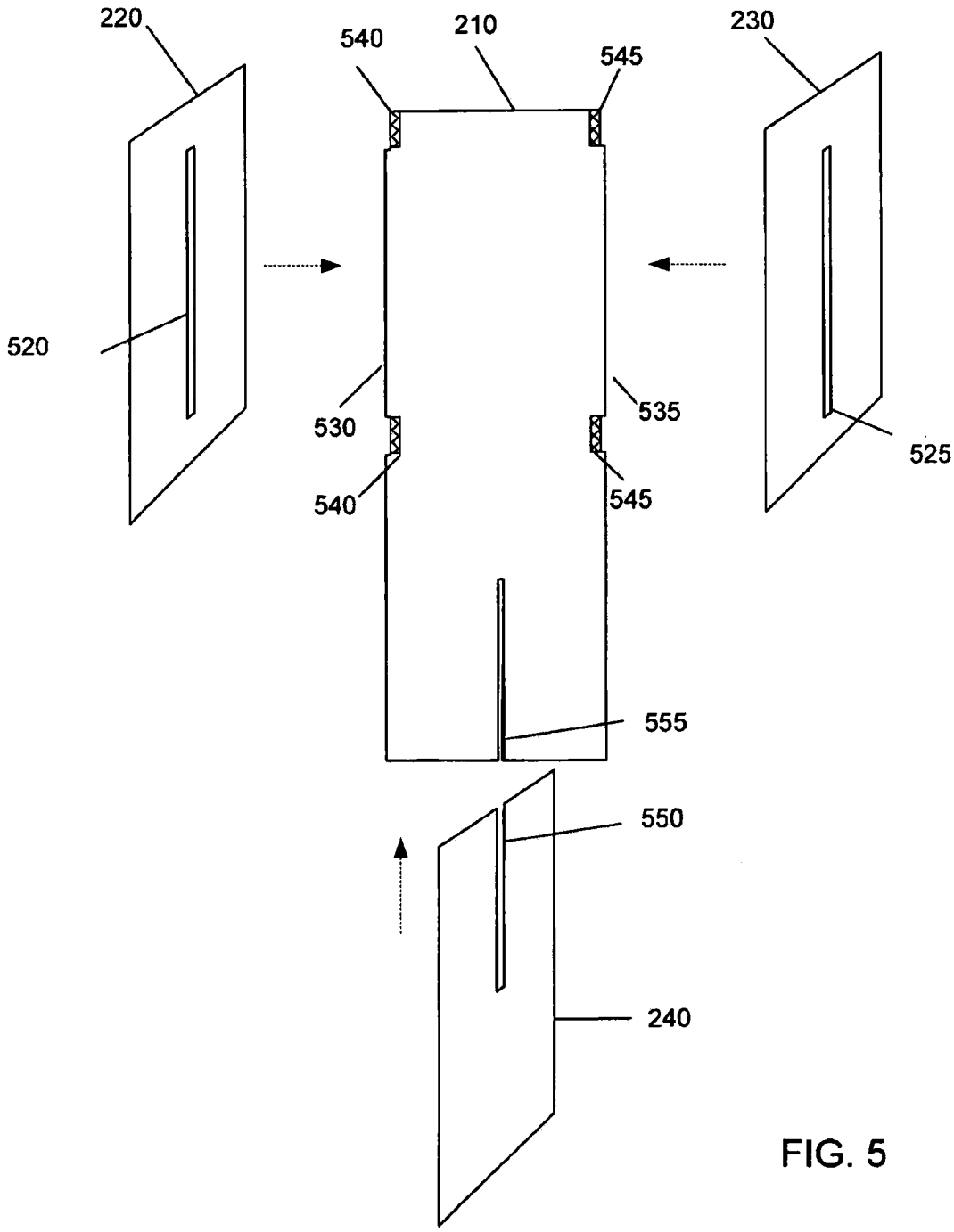
FIG. 5 illustrates an exploded view to show a method of manufacture of the antenna apparatus of FIG. 3, in one embodiment in accordance with the present invention.

FIG. 5 illustrates an exploded view to show a method of manufacture of the antenna apparatus 110 of FIG. 3, in one embodiment in accordance with the present invention. In this embodiment, the substrates 210-240 are first formed from a single PCB. The PCB may comprise a part of a large panel upon which many copies of the substrates 210-240 are formed. After being partitioned from the PCB, the substrates 210-240 are oriented and affixed to each other.

An aperture (slit) 520 of the substrate 220 is approximately the same width as the thickness of the substrate 210. The slit 520 is aligned to and slid over a tab 530 included on the substrate 210. The substrate 220 is affixed to the substrate 210 with electronic solder to the solder pads 540. The solder pads 540 are oriented on the substrate 210 to electrically and/or mechanically bond the slot antenna of the substrate 220 to the coupling network and/or the ground components of the substrate 210.

Alternatively, the substrate 220 may be affixed to the substrate 210 with conductive glue (e.g., epoxy) or a combination of glue and solder at the interface between the substrates 210 and 220. However, affixing the substrate 220 to the substrate 210 with electronic solder at the solder pads 540 has the advantage of reducing manufacturing steps, since the electronic solder can provide both a mechanical bond and an electrical coupling between the slot antenna of the substrate 220 and the coupling network of the substrate 210.

In similar fashion to that just described, to affix the substrate 230 to the substrate 210, an aperture (slit) 525 of the substrate 230 is aligned to and slid over a tab 535 included on the substrate 210. The substrate 230 is affixed to the substrate 210 with electronic solder to solder pads 545, conductive glue, or a combination of glue and solder.

To affix the substrate 240 to the substrate 210, a mechanical slit 550 of the substrate 240 is aligned with and slid over a corresponding slit 555 of the substrate 210. Solder pads (not shown) on the substrate 210 and the substrate 240 electrically and/or mechanically bond the dipoles of the substrate 240 to the coupling network and/or the ground components of the substrate 210.

Figure 6:
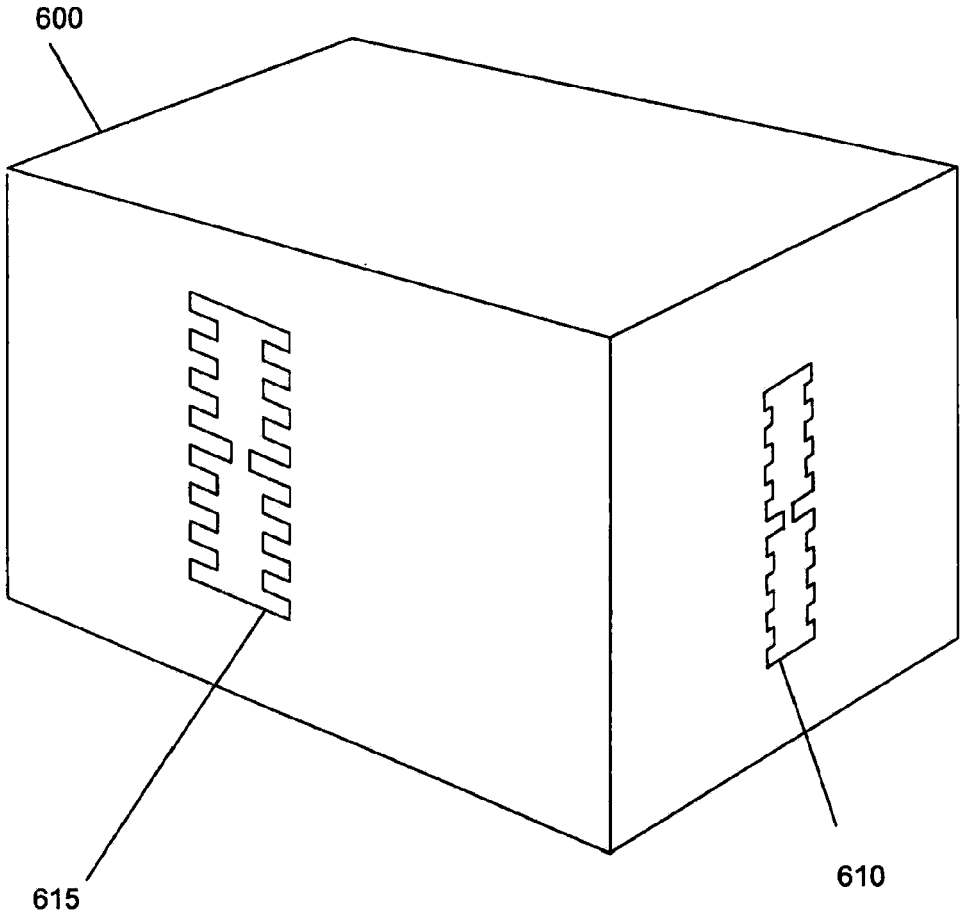
FIG. 6 illustrates an alternative embodiment for the slots of the antenna apparatus in a housing of the system of FIG. 1.

FIG. 6 illustrates an alternative embodiment for the slots of the antenna apparatus 110 in a housing 600 of the system 100 of FIG. 1. The housing 600 incorporates the antenna apparatus 110 by including a number of slot antennas 610 and 615 (only two slots depicted for clarity) on one or more faces of the housing 600. The dipoles depicted in FIG. 3 may be included internally to the housing 600 (e.g., for a plastic housing), provided externally to the housing 600 (e.g., for a metal or other RF-conductive housing), or not included in the antenna apparatus 110.

The slots 610 and 615 include fingers for reducing the overall size of the slots, as described herein. The slots 610 and 615 may be oriented in the same or different directions. In some embodiments, the housing 600 comprises a metallic or otherwise conductive housing 600 for the system 100, and one or more of the slots 610 and 615 are integral with, and formed from, the housing 600. For example, the housing 600 may be formed from metal such as stamped steel, aluminum, or other RF conducting material.

The slots 610 and 615 may be formed from, and therefore coplanar with, the housing 600. To prevent damage from foreign matter entering the openings in the housing 600 formed by the slots, the slots may be covered with non-conductive material such as plastic. In alternative-embodiments, one or more of the slots 610 and 615 may be separately formed (e.g., of PCB traces or conductive foil) and conformally-mounted to the housing 600 of the system 100, for example if the housing 600 is made of non-conductive material such as plastic.

Although FIG. 6 depicts two slots 610 and 615, one or more slots may be formed on one or more sizes of the housing. For example, with a 6-sided housing (top, bottom, and four sides), four slots may be included in the housing, one slot on each of the vertical sides of the housing other than the top and bottom. The slots may be oriented in the same or different directions, depending on the desired radiation pattern.

For the embodiment of FIG. 6 in which the antenna apparatus 110 incorporates slots on the housing 600, the antenna element selector (FIG. 3) may comprise a separate structure (not shown) from the slots 610 and 615. The antenna element selector may be mounted on a relatively small PCB, and the PCB may be electrically coupled to the slots 610 and 615, for example by RF coaxial cables.

Other Embodiments

Although not depicted, the system 100 of FIG. 1 may include multiple parallel communication devices 120 coupled to the antenna apparatus 110, for example in a multiple input multiple output (MIMO) architecture such as that disclosed in U.S. application Ser. No. 11/190,288 titled "Wireless System Having Multiple Antennas and Multiple Radios" filed Jul. 26, 2005. For example, the horizontally polarized slots of the antenna apparatus 110 may be coupled to a first of the communication devices 120 to provide selectable directional radiation patterns with horizontal-polarization, and the vertically polarized dipoles may be coupled to the second of the communication devices 120 to provide selectable directional radiation patterns with vertical polarization. The antenna feed port 340 and associated coupling network of FIG. 3A may be modified to couple the first and second communication devices 120 to the appropriate antenna elements of the antenna apparatus 110. In this fashion, the system 100 may be configured to provide a MIMO capable system with a combination of directional to omnidirectional coverage as well as horizontal and/or vertical polarization.

In other alternative embodiments, the antenna elements of the antenna apparatus 110 may be of varying dimension, for operation at different operating frequencies and/or bandwidths. For example, with two radio frequency feed ports 340 (FIG. 3) and two communications devices 120 (FIG. 1), the antenna apparatus 110 may provide operation at two center frequencies and/or operating bandwidths.

In some embodiments, to further minimize or reduce the size of the antenna apparatus 110, the dipoles may optionally incorporate one or more loading structures as are described in U.S. application Ser. No. 11/041,145 titled "System and Method for a Minimized Antenna Apparatus with Selectable Elements" filed Jan. 21, 2005. The loading structures are configured to slow down electrons changing the resonance of the dipole, thereby making the dipole electrically shorter. At a given operating frequency, providing the loading structures allows the dimension of the dipole to be reduced.

In some embodiments, to further minimize or reduce the size of the antenna apparatus 110, the ½-wavelength slots depicted in FIG. 3 may be "truncated" in half to create ¼-wavelength modified slot antennas. The ¼-wavelength slots provide a different radiation pattern than the ½-wavelength slots.

A further variation is that the antenna apparatus 110 disclosed herein may incorporate the minimized antenna apparatus disclosed in U.S. application Ser. No. 11/041,145 wholly or in part. For example, the slot antennas described with respect to FIG. 3 may be replaced with the minimized antenna apparatus of U.S. application Ser. No. 11/041,145.

In alternate embodiments, although the antenna apparatus 110 is described as having four dipoles and three slots, more or fewer antenna elements are contemplated. Generally, as will be apparent to a person of ordinary skill upon review of the applications referenced herein, providing more antenna elements of a particular configuration (more dipoles, for example), yields a more configurable radiation pattern formed by the antenna apparatus 110.

An advantage of the foregoing is that in some embodiments the antenna elements of the antenna apparatus 110 may each be selectable and may be switched on or off to form various combined radiation patterns for the antenna apparatus 110. Further, the antenna apparatus 110 includes switching at RF as opposed to switching at baseband. Switching at RF means that the communication device 120 requires only one RF up/down converter. Switching at RF also requires a significantly simplified interface between the communication device 120 and the antenna apparatus 110. For example, the antenna apparatus 110 provides an impedance match under all configurations of selected antenna elements, regardless of which antenna elements are selected.

Another advantage is that the antenna apparatus 110 comprises a 3-dimensional manufactured structure of relatively low complexity that may be formed from inexpensive and readily available PCB material.

The invention has been described herein in terms of several preferred embodiments. Other embodiments of the invention, including alternatives, modifications, permutations and equivalents of the embodiments described herein, will be apparent to those skilled in the art from consideration of the specification, study of the drawings, and practice of the invention, The embodiments and preferred features described above should be considered exemplary, with the invention being defined by the appended claims, which therefore include all such alternatives, modifications, permutations and equivalents as fall within the true spirit and scope of the present invention.

What is claimed is:

1. A system, comprising:

a housing;

a communication device that can generate or receive a radio frequency (RF) signal; and an antenna apparatus integral with the housing, the antenna apparatus including a first planar element that can radiate or receive the RF signal in a horizontal polarization and a second planar element that can radiate or receive the RF signal in a vertical polarization, the antenna apparatus including one or more slot antennas having a plurality of loading elements that decrease a footprint of the slot antenna.

2. The system of claim 1, wherein one or more of the slot antennas comprises an aperture formed in the housing.

3. The system of claim 1, wherein the antenna apparatus can further radiate or receive the RF signal in a diagonal polarization.

4. The system of claim 1, wherein the antenna apparatus is further configured to concentrate a radiation pattern of the first planar element.

5. The system of claim 1, wherein the antenna apparatus further radiates or receives the RF signal in a substantially omnidirectional radiation pattern.

6. The system of claim 1 wherein the second planar element includes a reflector, the reflector configured to broaden a frequency response of the antenna apparatus.

7. The system of claim 1 wherein the second planar element includes a director, the director configured to direct a frequency response of the antenna apparatus.

* * * * *